US010633899B2

(12) United States Patent
Eshuis

(10) Patent No.: US 10,633,899 B2
(45) Date of Patent: Apr. 28, 2020

(54) MULTI-PIECE TOP CAP FOR A GEARED CONTINUOUS HINGE

(71) Applicant: Select Products Ltd., Portage, MI (US)

(72) Inventor: Joseph James Eshuis, Portage, MI (US)

(73) Assignee: Select Products Limited, Portage, MI (US)

( * ) Notice: Subject to any disclaimer, the term of this patent is extended or adjusted under 35 U.S.C. 154(b) by 0 days.

(21) Appl. No.: 16/145,744

(22) Filed: Sep. 28, 2018

(65) Prior Publication Data

US 2020/0102776 A1 Apr. 2, 2020

(51) Int. Cl.

| | |
|---|---|
| ***E05D 11/00*** | (2006.01) |
| ***E05D 3/12*** | (2006.01) |
| ***E05C 17/54*** | (2006.01) |
| ***E05D 7/04*** | (2006.01) |

(52) U.S. Cl.

CPC ..... *E05D 11/0054* (2013.01); *E05C 17/54* (2013.01); *E05D 3/122* (2013.01); *E05D 7/0423* (2013.01); *E05D 2007/0461* (2013.01); *E05Y 2600/632* (2013.01); *E05Y 2900/132* (2013.01)

(58) Field of Classification Search

CPC ..... E05D 11/0054; E05D 2011/0063; E05D 2011/0072; E05D 3/122; E05C 17/54; E05Y 2900/132; Y10T 16/533; Y10T 16/5335

See application file for complete search history.

(56) References Cited

U.S. PATENT DOCUMENTS

| | | | | |
|---|---|---|---|---|
| 1,158,237 A | | 12/1874 | Blake | |
| 310,637 A | | 1/1885 | Barnekow | |
| 2,047,909 A | | 7/1936 | North | |
| 2,585,836 A | | 2/1952 | Quigley | |
| 3,206,792 A | * | 9/1965 | Beck | E05D 3/02 16/250 |
| 3,229,323 A | | 1/1966 | Hensgen | |
| 3,252,179 A | | 5/1966 | Watson | |
| 3,431,590 A | | 3/1969 | Anderson | |

(Continued)

FOREIGN PATENT DOCUMENTS

GB 2528545 B * 9/2017 ..... E05D 11/0054

OTHER PUBLICATIONS

Photograph that is representative of an angle-cut tip for a continuous geared hinge that was publicly used or on sale more than one (1) year prior to the filing date of U.S. Appl. No. 61/231,249, filed Aug. 4, 2009.

*Primary Examiner* — Chuck Y Mah

(74) *Attorney, Agent, or Firm* — Honigman LLP

(57) ABSTRACT

A multi-piece hinge cap covers an upper surface of an installed geared continuous hinge to provide ligature resistance with a door supported by the installed geared continuous hinge in a closed position. The multi-piece hinge cap has a frame cap that attaches at a vertical member of a door frame above a frame leaf of the installed geared continuous hinge. Also, the multi-piece hinge cap has a door cap that attaches at the door adjacent to the frame cap and above a door leaf of the installed geared continuous hinge. The frame and door caps each include an upper surface having a downward sloping angle that slopes downward from the door frame and the door, respectively, and extends over the exposed upper surface of the installed geared continuous hinge.

18 Claims, 9 Drawing Sheets

(56) References Cited

U.S. PATENT DOCUMENTS

| | | | | |
|---|---|---|---|---|
| 4,240,225 | A | 12/1980 | Sartain | |
| 4,411,045 | A | 10/1983 | Rock et al. | |
| 4,643,318 | A * | 2/1987 | Kopp | A47K 17/022 211/105.1 |
| 4,713,922 | A | 12/1987 | Ingold | |
| 5,680,675 | A | 10/1997 | Davis | |
| 5,911,264 | A | 6/1999 | Smrke et al. | |
| 6,735,821 | B1 * | 5/2004 | Christman, Jr. | E05D 11/0054 16/250 |
| 7,536,747 | B2 | 5/2009 | Christeson et al. | |
| 7,650,670 | B2 | 1/2010 | Baer et al. | |
| 8,312,596 | B2 * | 11/2012 | Self | A47K 3/36 16/250 |
| 8,505,880 | B2 * | 8/2013 | Langenwalter | E04H 17/1443 256/65.08 |
| D719,010 | S * | 12/2014 | Russo | E05D 11/0054 D8/323 |
| 8,898,861 | B2 * | 12/2014 | Schau | E05D 11/0054 16/250 |
| RE46,240 | E | 12/2016 | Schau | |
| 10,385,598 | B2 * | 8/2019 | Shah | E05D 3/122 |
| 2004/0154129 | A1 | 8/2004 | Martinez-Munoz | |
| 2007/0261201 | A1 | 11/2007 | Baer et al. | |
| 2008/0053004 | A1 * | 3/2008 | Oberoi | E04D 1/30 52/43 |
| 2013/0019434 | A1 * | 1/2013 | Kopp | E04F 11/1802 16/110.1 |

* cited by examiner

MULTI-PIECE TOP CAP FOR A GEARED CONTINUOUS HINGE

TECHNICAL FIELD

This disclosure relates generally to door hinges, and more particularly relates to geared continuous hinges and associated devices for preventing misuse of the top surface thereof.

BACKGROUND

It is generally known that hinges can be used for purposes other than facilitating the opening and closing of a supported door, such as for the hanging of objects or other uses that may be destructive or damaging to the hinge and door. In addition to misuses of a hinge that can lead to damage to the hinge, such as unhinging the door from the door frame, other misuse of the hinge can result in injury or death to those misusing the hinge. For example, inmates of institutions like prisons or metal hospitals may hang or abuse themselves or others from the protruding top surfaces of a hinge. Accordingly, it is relatively common for hinge installations, among other common items mounted in such institutions or provided to inmates, to be ligature resistant and otherwise designed to deter self-inflicted injury. Specifically, it is known to attach a unitary hinge cap to a header of a door frame to overlay an exposed top surface of a continuous geared door hinge, such as described in U.S. Pat. No. RE46,240.

SUMMARY

The present disclosure provides a multi-piece hinge cap for covering an exposed upper surface of a geared continuous hinge to prevent the misuse of the exposed upper surface, such as the hanging of objects or other abusive or destructive uses. Geared continuous hinges have a frame leaf in meshed engagement with a door leaf and a cover holding the meshed gear sections of the frame leaf and door leaf together along a length of the geared continuous hinge. When installed at a door frame, such as when retro-fitting an existing doorway with a geared continuous hinge, the exposed upper surface of the geared continuous hinge typically includes a flat upper surface of the door leaf, the frame leaf, and the cover, which can have sharp edges and generally horizontal supportive areas. A frame cap attaches to the door frame above the frame leaf of the geared continuous hinge, while a door cap attaches to the supported door above the door leaf and adjacent to the frame cap. The frame and door caps each have an upper surface with a downward sloping angle that slopes downward from the door frame and the door, respectively. The frame and door caps together extend over the exposed upper surface of the geared continuous hinge to provide ligature resistance with the door in a closed position.

According to one aspect of the present disclosure, a multi-piece hinge cap covers an upper surface of an installed geared continuous hinge to provide ligature resistance with a door supported by the installed geared continuous hinge in a closed position. The multi-piece hinge cap has a frame cap that attaches at a vertical member of a door frame above a frame leaf of the installed geared continuous hinge. Also, the multi-piece hinge cap has a door cap that attaches at the door adjacent to the frame cap and above a door leaf of the installed geared continuous hinge. The frame and door caps each include an upper surface having a downward sloping angle that slopes downward from the door frame and the door, respectively, and extends over the exposed upper surface of the installed geared continuous hinge.

To securely mount the frame cap and the door cap at the respective door frame and door, a fastener may be provided that has a shank portion that extends through a countersunk hole in the frame cap or the door cap. A head portion of the fastener may be at least partially disposed in an enlarged section of the countersunk hole to conceal the head portion, so as to prevent similar misuse of the fastener, such as hanging objects from the head portion of the fastener.

The door cap may also include an arm portion that protrudes toward the frame cap. With the door in the closed position, the arm portion overlaps with a recessed portion of the frame cap. The arm portion may also cover a head of fastener, such as a fastener that is engaged through the recessed portion of the frame cap. Further, the arm portion of the door cap may contact the recessed portion of the frame cap along an interface line between the upper surfaces of the door cap and the frame cap. The interface line may be curved or shaped to permit pivotal movement of the door about the geared continuous hinge toward an open position.

According to another aspect of the present disclosure, a ligature resistant hinge assembly is provided that utilizes a geared continuous hinge having a frame leaf in meshed engagement with a door leaf, where the frame leaf mounts at a door frame and the door leaf mounts to a door. A cover of the geared continuous hinge holds meshed gear sections of the frame leaf and door leaf together along a length of the geared continuous hinge, so as to allow the door to swing relative to door frame between the open and closed positions. A frame cap with a wedge shape attaches to the door frame above the frame leaf of the geared continuous hinge. Also, a door cap with a wedge shape attaches to the door above the door leaf and adjacent to the frame cap. The frame and door caps each have an upper surface with a downward sloping angle that is configured to slope downward from the door frame and the door, respectively, and extend over an exposed upper surface of the geared continuous hinge. With the door in the closed position, the door cap may contact the frame cap and align the upper surfaces of the door cap and the frame cap to provide a continuous sloped surface that overhangs the exposed upper surface of the installed geared continuous hinge. An interface seam or line between the upper surfaces of the door cap and the frame cap may have a curved shape that is configured to permit movement of the door toward the open position.

According to yet another aspect of the present disclosure, a method is provided for deterring or preventing a person from hanging objects on an exposed upper surface of an installed geared continuous hinge with a door supported by the installed geared continuous hinge in a closed position, thus making the geared continuous hinge ligature resistant. The method includes fastening a frame cap at a door frame above a frame leaf of the installed geared continuous hinge. A door cap is positioned adjacent to the frame cap and is fastened at the door above a door leaf of the installed geared continuous hinge. The frame and door caps each have a rear surface that mounts against the respective door frame and door and an angled front surface that slopes forward and downward from the rear surface to extend over the exposed upper surface of the respective frame leaf and door leaf. With the door in the closed position, the upper surfaces of the door cap and the frame cap may be aligned to provide a continuous and generally uniform sloped surface.

These and other objects, advantages, purposes, and features of the present disclosure will become apparent upon review of the following specification in conjunction with the drawings.

DETAILED DESCRIPTION

Figure 1:
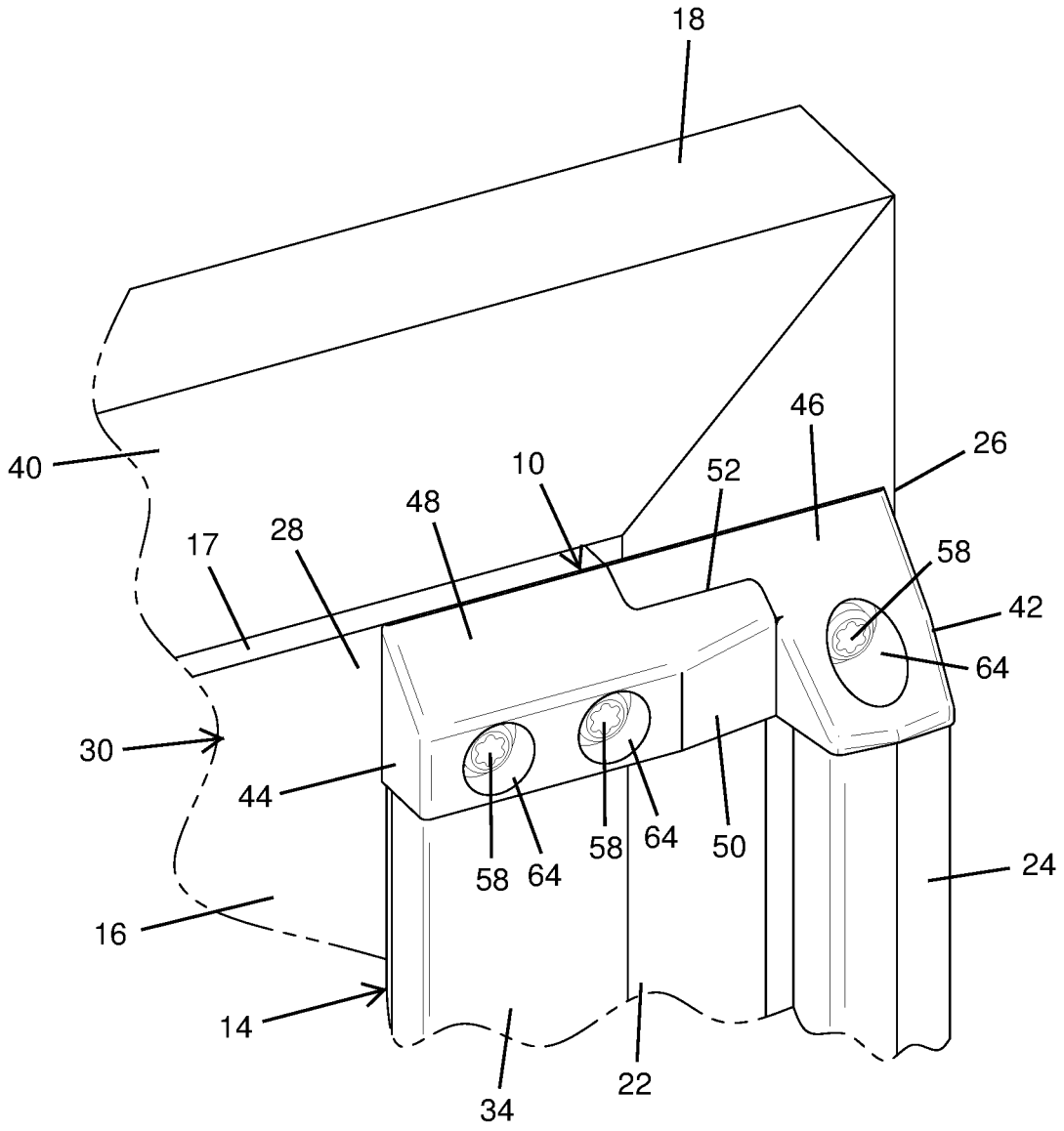
FIG. 1 is an upper perspective view of a multi-piece cap mounted above a geared continuous hinge that is installed at a door frame and corresponding door, in accordance with the present disclosure.

Referring now to the drawings and the illustrative embodiments depicted therein, a multi-piece hinge cap 10 is provided for covering or overhanging an exposed upper surface 12 of a geared continuous hinge 14 with the door 16 in a closed position, such as shown in FIG. 1. By covering or overhanging the exposed upper surface 12 of the geared continuous hinge 14, the multi-piece hinge cap 10 prevents the misuse of the upper surface 12 of the geared continuous hinge 14, such as hanging objects or ligatures, using the sharp edges for abusive or destructive purposes, or attempting to pry the hinge or door away from the door frame 18. The multi-piece hinge cap 10 is particularly useful for covering geared continuous hinges that are mounted in doorways that do not have a header or otherwise have a header that is incapable or undesirable to support a hinge cap. Also, the multi-piece hinge cap 10 is similarly suitable for use with a geared continuous hinge that does not extend up to the top of a door, such that there is an area unoccupied by the hinge along the upper portion of the vertical edge of the door. In such an arrangement, if a unitary hinge cap were to be installed at an associated header of the door frame, the unitary cap would be spaced away from the upper surface of the geared continuous hinge, and thus not be capable of providing the desired protection and ligature resistance.

Figure 5:
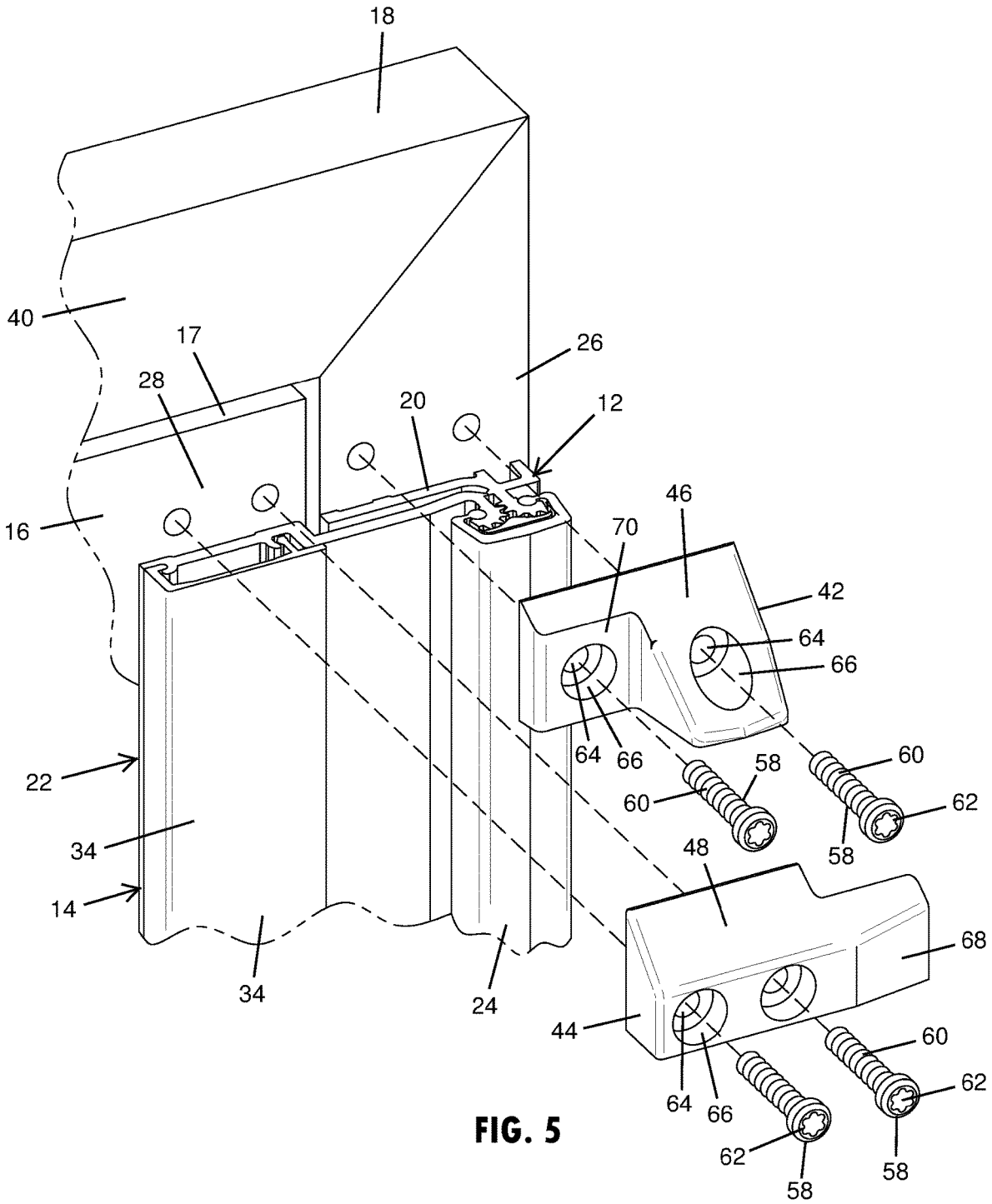
FIG. 5 is an exploded upper perspective view of the multi-piece cap exploded away from the installed geared continuous hinge shown in FIG. 1, exposing an upper surface of the geared continuous hinge.
Figure 6:
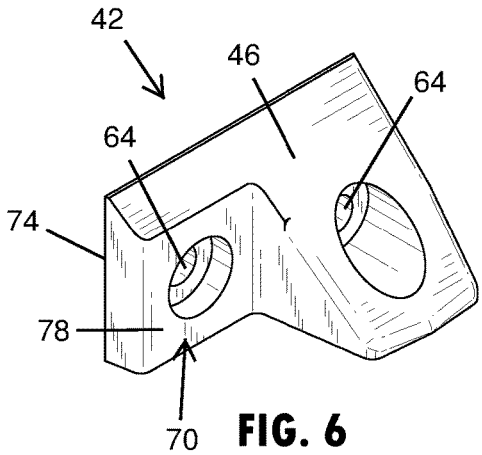
FIG. 6 is an isolated upper perspective view of a frame cap shown in FIG. 1.
Figure 7:
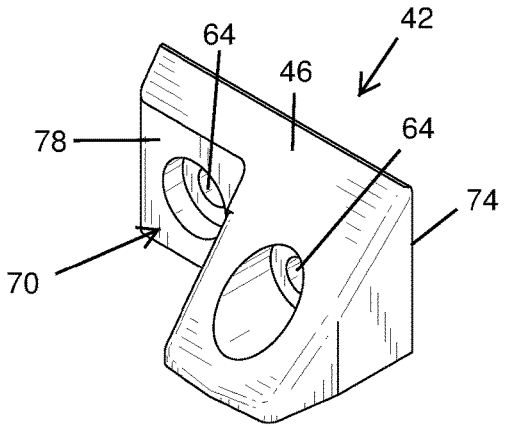
FIG. 7 is another upper perspective view of the frame cap shown in FIG. 6.
Figure 8:
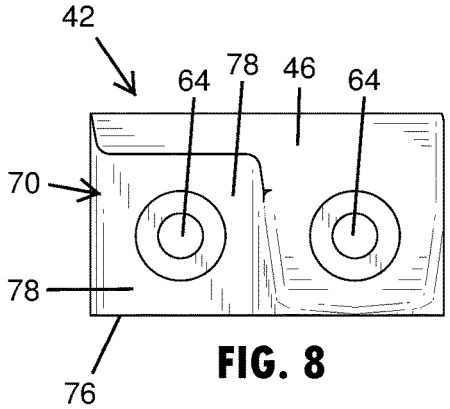
FIG. 8 is a front elevation view of the frame cap shown in FIG. 6.
Figure 9:
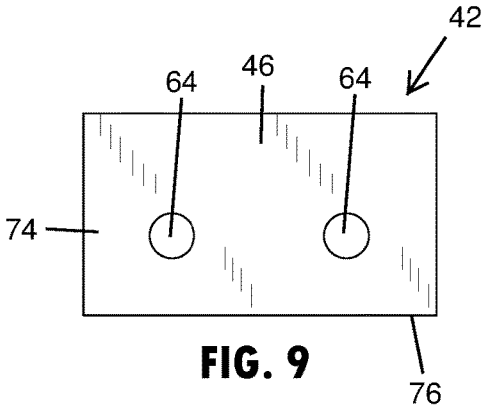
FIG. 9 is a rear elevation view of the frame cap shown in FIG. 6.
Figure 10:
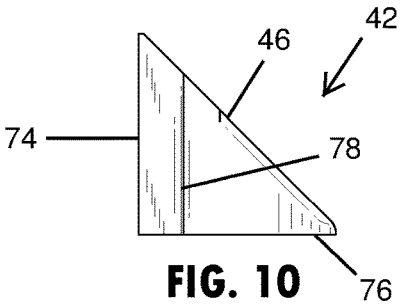
FIG. 10 is a left side elevation view of the frame cap shown in FIG. 6.
Figure 11:
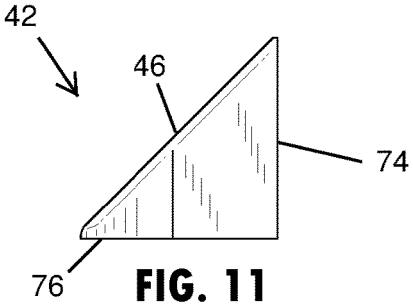
FIG. 11 is a right side elevation view of the frame cap shown in FIG. 6.

A geared continuous hinge 14 generally has a frame leaf 20 in meshed engagement with a door leaf 22 and a cover 24 that holds meshed gear sections 20*a*, 22*a* of the frame leaf 20 and door leaf 22 together along a length of the geared continuous hinge 14, such as shown in FIG. 5. The cover 24 is held in place relative to the frame and door leaves 20, 22 with bearing blocks that are secured at intermittent slots located along the length of the hinge 14, where such slots may formed horizontally in the gear sections of the hinge. Geared continuous hinges are essentially of two types: a full surface type hinge and a mortise type hinge. A full surface type hinge refers to both of the hinge leafs being installed at the outer surface of the door and door frame, such that both hinge leafs may be exposed after installation of the hinge between the door and door frame. The mortise type hinge refers to at least one of the hinge leafs being mortised or recessed into the edge of the door or inner face of the door frame, where a full mortise has both hinge leafs being mortised or recessed and a half mortise has one of the hinge leafs mortised or recessed. As shown in FIG. 5, the geared continuous hinge 14 is a full surface type hinge, however, the multi-piece hinge cap 10 may also be utilized with a half mortise type hinge.

Figure 4:
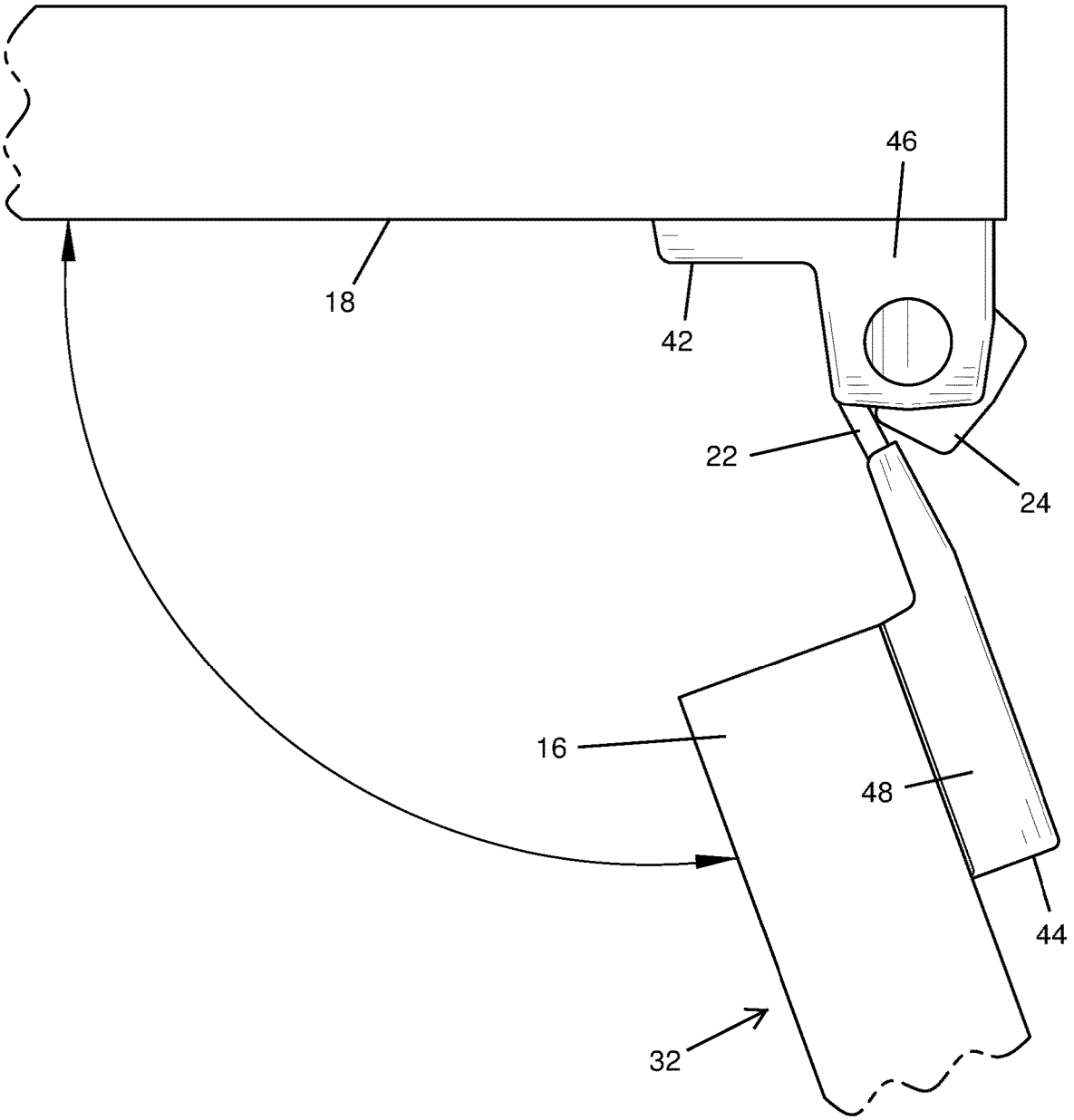
FIG. 4 is a top view of the multi-piece cap mounted above the geared continuous hinge, showing the door moved to an open position.

When the geared continuous hinge 14 is installed at a door frame 18, such as when retro-fitting an existing doorway with a geared continuous hinge, the frame leaf 20 is attached to a vertical member 26 of the door frame 18, which may also be referred to as the side jamb or hinge jamb. The door leaf 22 of the geared continuous hinge 14 is attached along the vertical edge portion 28 of the door 16 for the door 16 to be operable to pivot about the geared continuous hinge 14 between a closed position 30 and an open position 32. In the closed position 30, such as shown in FIG. 1, the door 16 is seated or positioned in the opening of the door frame 18. In the open position 32, such as shown in FIG. 4, the door 16 is pivoted out of the opening of the door frame 18 and away from the lock jamb on the opposing side of the door frame 18 from the hinge jamb 26. The attachment of the frame leaf 20 and door leaf 22 of the geared continuous hinge 14 is provided with fasteners, such as security screws or rivets, but may also or alternatively employ adhesive or welding to provide a secure installation.

When installed at the door 16 and door frame 18, the frame leaf 20 and/or door leaf 22 of the geared continuous hinge 14 may have a fastener cover 34 that is secured vertically along an exterior side of the respective leaf to conceal the fasteners used to mount the leaf at the respective door or door frame. For example, as shown in FIGS. 3A and 5, the fastener cover 34 is snap-fit over a base portion 36 of the door leaf 22 that is mounted against the door 16 and secured in place with fasteners that engage the door 16. The fastener cover 34 may also include other fastening means, such as a concealed fastener, to hold the fastener cover over the base portion of the respective leaf.

The exposed upper surface 12 of the geared continuous hinge 14 typically includes a flat upper surface of the frame leaf 20, the door leaf 22, and the cover 24, which can have a sharp outer edge 38 and several supportive areas. The exposed upper surface 12 is not an entire continuous planar surface since there are substantial openings in the surface, such as formed by the spacing between the gear sections 20*a*, 22*a* and the cover 24 and the spacing between the fastener cover 34. As shown in FIG. 5, the exposed upper surface 12 also includes the flat upper surface of the fastener cover 34 of the door leaf 22, where each of the flat upper surfaces that constitute the exposed upper surface 12 are generally horizontal and in alignment with each other about a common horizontal plane. The common horizontal plane of the exposed upper surface 12 of the geared continuous hinge 14 is below the top surface 17 of the door 16 a distance sufficient to accommodate the multi-piece hinge cap 10 disclosed herein. As further shown in FIG. 5, the mounting location of the multi-piece hinge cap 10 below the header 40 of the door frame 18 allows the multi-piece hinge cap 10 and geared continuous hinge 14 to be installed at doorways that do not have a header or otherwise have a header that is located or designed to be unsuitable for providing a unitary hinge cap or the like.

The multi-piece hinge cap 10 includes a frame cap 42 that attaches to the hinge jamb or vertical member 26 of the door frame 18 immediately above the frame leaf 20 of the geared continuous hinge 14. Also, the multi-piece hinge cap 10 includes a door cap 44 that attaches to the supported door 16 immediately above the door leaf 22 and adjacent to the frame cap 42. The frame and door caps 42, 44 each have a sloped upper surface 46, 48 that slopes downward from the door frame 18 and the door 16, respectively, at an angle of approximately 40 to 50 degrees relative to the vertical planes of the door 16 and the door frame 18 and preferably at approximately 45 degrees. The angle of the sloped upper surfaces 46, 48 may be larger or smaller than the 40 to 50 degree range and may be generally greater than 25 degrees to provide a sloped upper surface that prevents objects from being supported on the upper surface 12 of the hinge 14. Although the upper surfaces 46, 48 are shown as generally planar surfaces, it is contemplated that the upper surfaces may have a convex or concave curved shape while still providing the desired function of similarly covering the exposed upper surface 12 of the hinge 14 and being generally incapable of supporting an object or harming oneself thereat.

Figure 2:
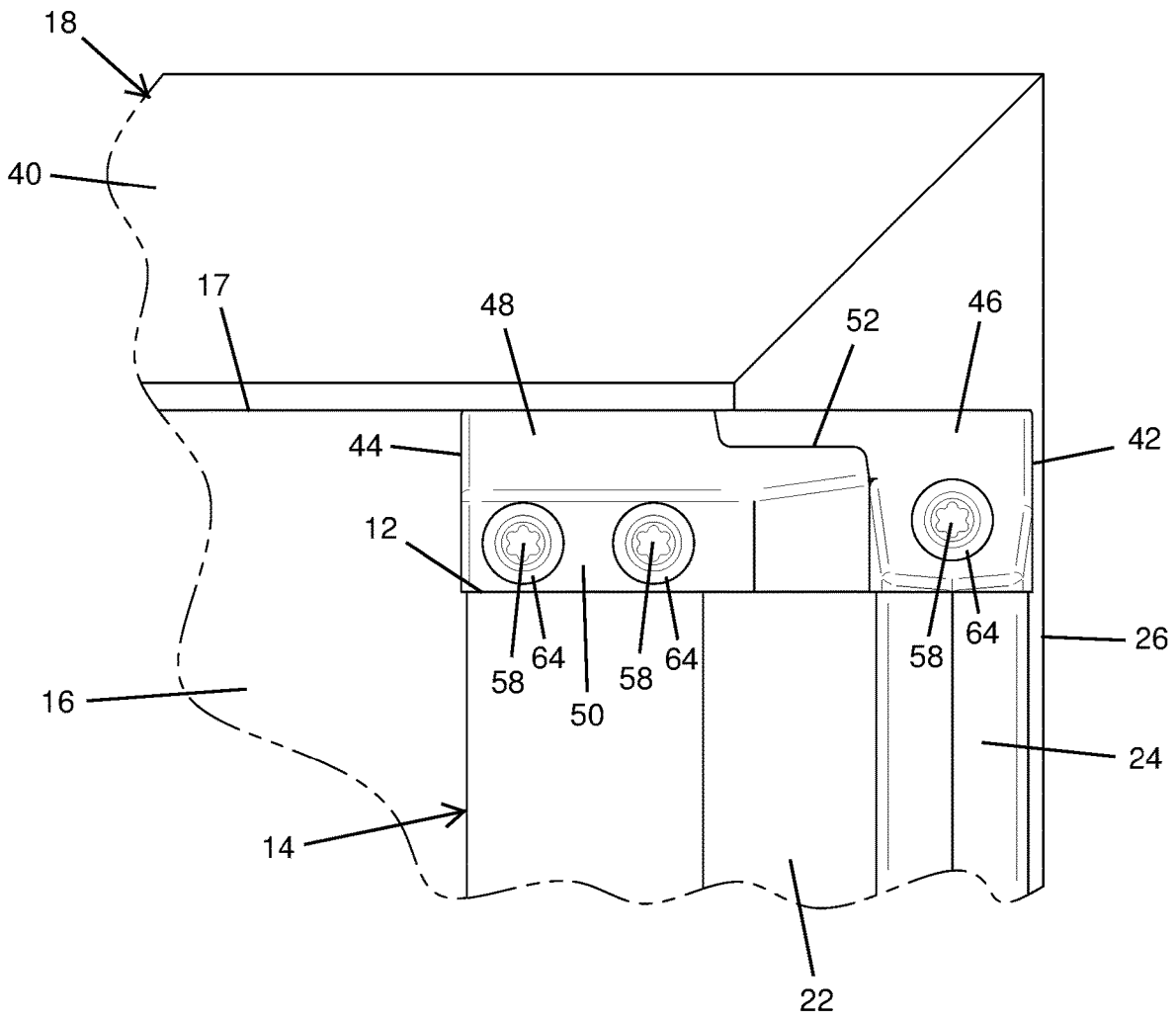
FIG. 2 is a front elevation view of the multi-piece cap mounted above the geared continuous hinge shown in FIG. 1.
Figure 3:
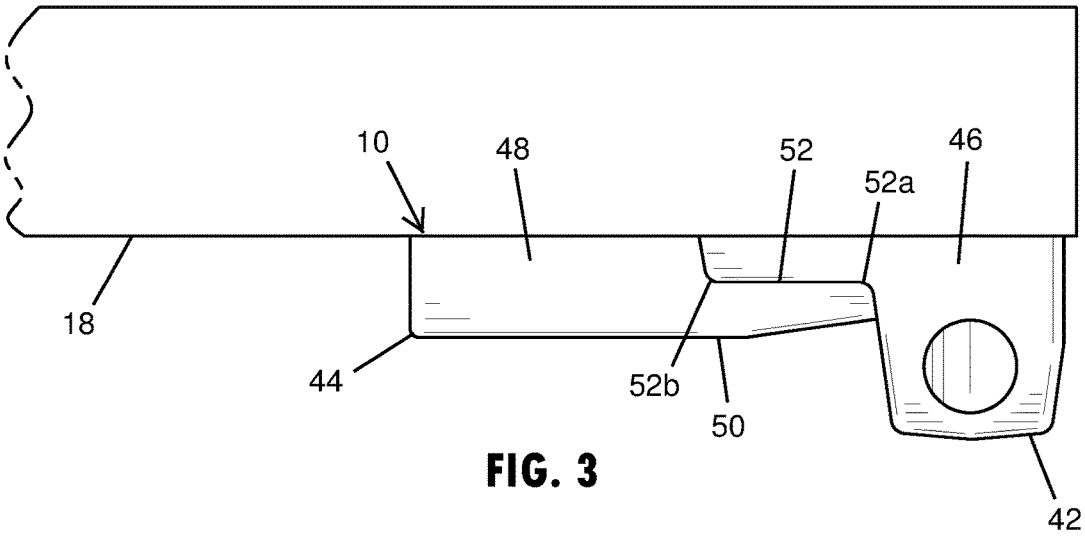
FIG. 3 is a top view of the multi-piece cap mounted above the geared continuous hinge shown in FIG. 1.
Figure 3A:
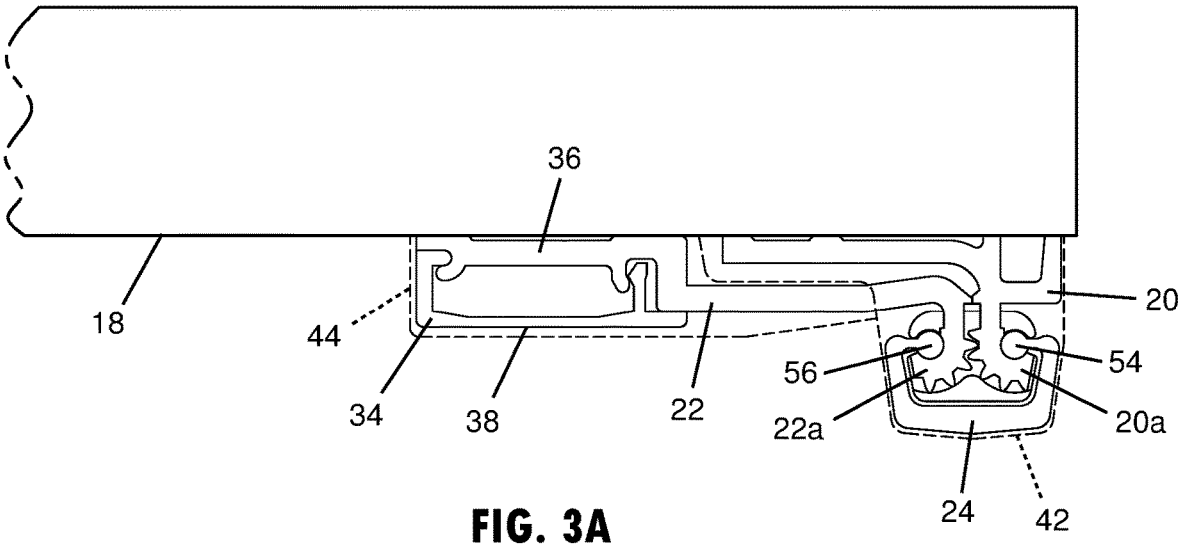
FIG. 3A is a top view of the geared continuous hinge shown in FIG. 3, showing the multi-piece cap in dashed lines.

As shown in FIGS. 1-3, with the door 16 in the closed position 30, the door cap 44 contacts the frame cap 42 and the upper surfaces 48, 46 of the door cap 44 and the frame cap 42 align to provide a continuous sloped surface that is configured to overhang the exposed upper surface 12 of the installed geared continuous hinge 14. However, it is understood that the upper surfaces 46, 48 of the hinge caps may have slopes or shapes that vary from each other, so long as such varied slopes do not interface to create ridges or surfaces capable of supporting a hanging object, such as a ligature. The sloped upper surfaces 46, 48 of the frame and door caps 42, 44 extend away from the door 16 and door frame 18 over the exposed upper surface 12 of the geared continuous hinge 14, such as to protrude forward a distance that is sufficient to generally meet or overhang the distal edge 38 of the upper surface 12, such as shown in FIG. 3A. By extending sufficiently away from the door frame 18 and the door 16, the frame and door caps 42, 44 cover or overhang the entire upper surface 12 of the geared continuous hinge 14 and provide ligature resistance with the door 16 supported by the installed geared continuous hinge 14 in a closed position 30.

To accommodate the various depths of the geared continuous hinge 14, such as apparent when viewed from above as shown in FIG. 3A, the door cap 44 and the frame cap 42 may have corresponding variations in depth. Specifically, as shown in FIG. 1, the frame cap 42 extends over the frame leaf 20 and the cover 24, which protrudes the greatest extent away from the door frame 18. In order to align the sloped upper surface 48 of the door cap 44 with the sloped upper surface 46 of the frame cap 42, the door cap 44 may have a shallower depth, such as provided by a vertical front surface 50. The vertical front surface 50 may be vertically oriented and may generally align with or be positioned slightly forward from the outer vertical surfaces of the door leaf 22, which are shown as the distal edge 38 of the upper surface 12. Thus, the hinge caps 42, 44 are attached to the door frame 18 and door 16 just over the position occupied by the top surface 12 of the installed geared continuous hinge 14 when the door 16 is closed, leaving no part of the top surface 12 exposed.

The door cap 44 and the frame cap 42 each comprise a rigid material that is hard and durable to minimize tampering or destruction of the respective cap and underlying hinge 14. The rigid material of the door cap 44 and the frame cap 42 is provided at each of the sloped upper surfaces 48, 46 to prevent the formation of indentations thereat, and thus maintain a smooth sloped surface. Such a rigid material is preferably a metal, such as an aluminum or stainless steel alloy, but may also or alternatively comprise plastic, ceramic, or fiberglass. The sloped upper surfaces 46, 48 of the frame and door caps 42, 44 may also have a low friction finish to prevent frictional engagement of a hanging item, where such a low-friction finish may be provided by a surface finishing or a surface coating or the like.

Figure 4A:
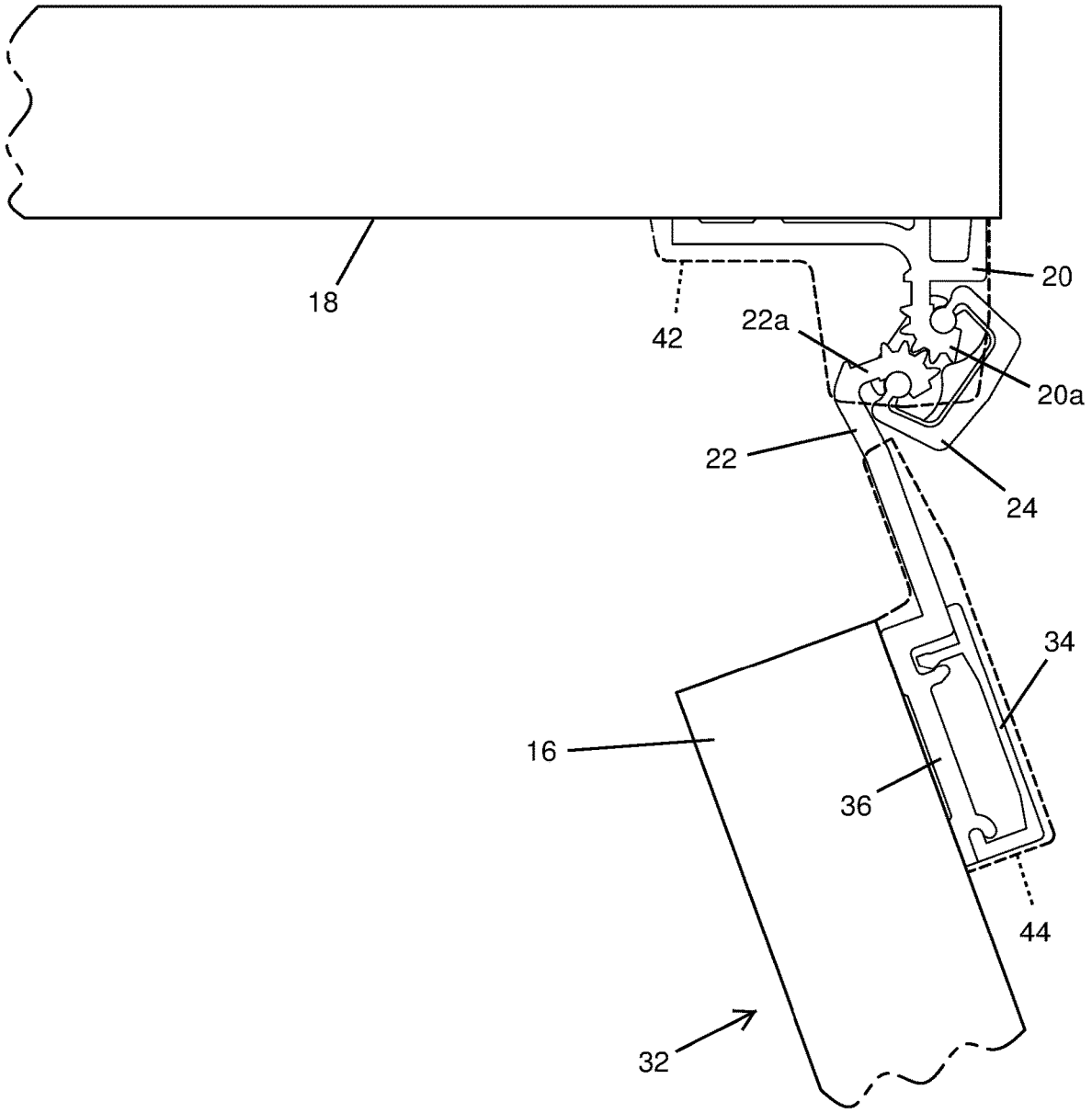
FIG. 4A is a top view of the geared continuous hinge shown in FIG. 4, showing the multi-piece cap in dashed lines.

With the door 16 in the closed position 30, the door cap 44 is near or in contact with the frame cap 42 along an interface line 52 between the sloped upper surfaces 46, 48 of the frame and door caps 42, 44. The interface line 52 joins the frame and door caps 42, 44 in a manner that prevents the caps from binding against each other upon movement of the door 16 toward an open position 32. The interface line 52, such as when viewed from above as in FIG. 3, is generally angled toward the frame cap 42. The interface line 52 may also have one or more curves between the upper surfaces 48, 46 of the door cap 44 and the frame cap 42, such as an S-shape when viewed from above. As shown in FIG. 3, the two curved sections 52*a*, 52*b* of the interface line 52 that form the S-shape may be provided to accommodate the dual-pivoting movement of the geared continuous hinge 10, which has two points 54, 56 of rotation about the engagement of each gear sections 20*a*, 22*a* of the hinge leafs 20, 22 with the hinge cover 24, such as shown in FIGS. 3A and 4A. As such, the two curved sections each curve approximately 90 degrees or more specifically about 100 degrees curvature between the generally strait sections of the interface line 52. It is contemplated that the curvature or shape of the interface line may vary from the illustrated example, such as to have different degrees of curvature between the two curved sections, more or fewer curved sections, and/or larger or smaller radiuses of curvature.

To securely mount the frame cap 42 and the door cap 44 at the respective door frame 18 and door 16, a fastener 58 may be provided that has a shank portion 60 and a head portion 62. The shank portion 60 extends through a countersunk hole 64 in the frame cap 42 or in the door cap 44 to mount the respective frame cap 42 or door cap 44 at the door frame 18 or door 16. The shank portion 60, as shown in FIG. 5, includes threads that engage the door frame 18 or door 16 to securely mount the respective hinge cap. The head portion 62 of the fastener 58 may be at least partially disposed in an enlarged section or head section 66 of the countersunk hole 64 to at least partially conceal the head portion 62, so as to prevent misuse of the fastener. The fastener 58 may be a security type screw, where the head portion 62 is configured to require a special tool to tighten or remove the screw. The fastener 58 and countersunk hole 64 may together be configured for the head portion 62 of the fastener 58 to be recessed far enough into the enlarged section or head section 66 of the countersunk hole 64 on the front side of the door cap or hinge cap to avoid interfering with the downwardly sloped upper surfaces 46, 48 of the frame and door caps 42, 44. As such, the enlarge section or head section 66 of the countersunk hole 64 may have a conical shaped bottom or flat-shaped bottom, such as shown in FIG. 5, to accommodate the corresponding head portion 62 of the fastener 58.

Referring again to the interface between the frame and door caps 42, 44, the interface line 52 may overlap a portion of one of the hinge cap with the other to prevent binding of the caps against each other upon opening or closing the door 16. As shown in FIGS. 1-5, the door cap 44 may include an arm portion 68 that protrudes toward the frame cap 42, and with the door 16 in the closed position 30, overlaps with a recessed portion 70 of the frame cap 42. The arm portion 68 may also cover the head portion 62 of the fastener 58 that is engaged through the recessed portion 70 of the frame cap 42. The countersunk hole 64 that is formed in the recessed portion 70 of the frame cap 42 has an enlarged section or head section 66 that entirely retains the head portion 62 of the fastener 58, such that the head portion 62 does not prevent the generally planar rear surface 72 of the arm portion 68 from contacting the recessed portion 70 of the frame cap 42. As such, the arm portion 68 of the door cap 44 may contact the recessed portion 70 of the frame cap 42 along the interface line 52 between the upper surfaces of the door cap 44 and the frame cap 42.

Figure 12:
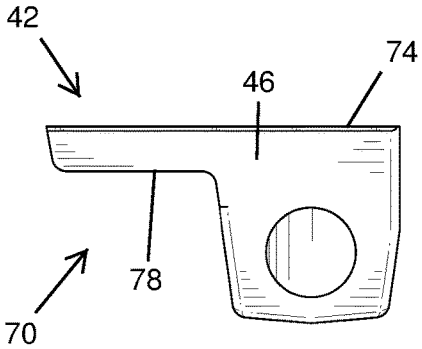
FIG. 12 is a top view of the frame cap shown in FIG. 6.
Figure 13:
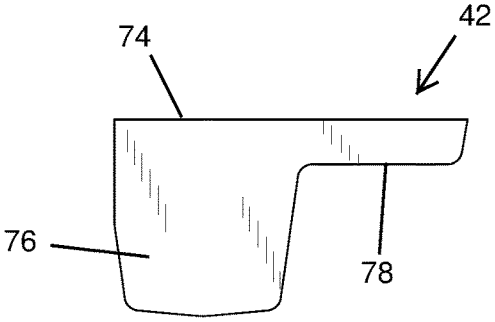
FIG. 13 is a bottom view of the frame cap shown in FIG. 6.
Figure 14:
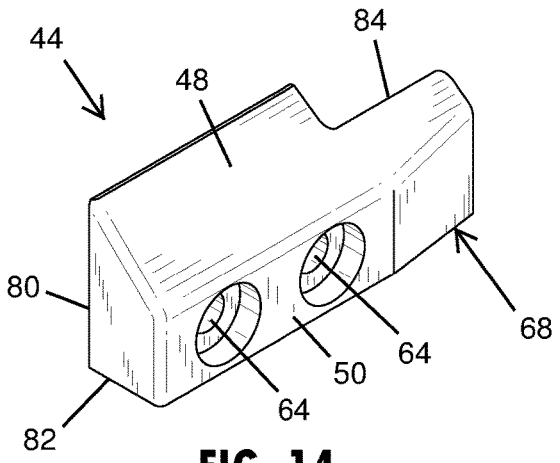
FIG. 14 is an isolated upper perspective view of a door cap shown in FIG. 1.
Figure 15:
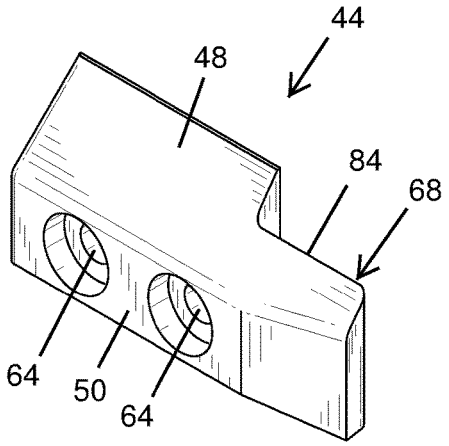
FIG. 15 is another upper perspective view of the door cap shown in FIG. 14.
Figure 16:
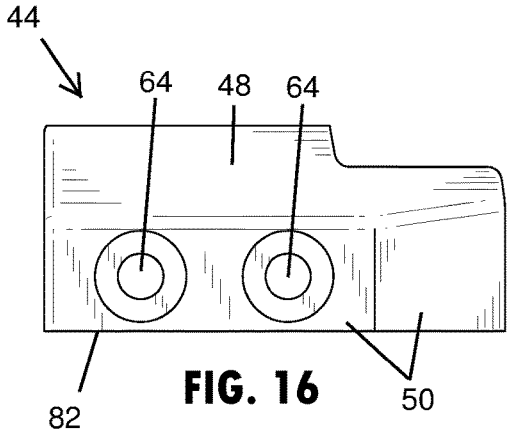
FIG. 16 is a front elevation view of the door cap shown in FIG. 14.
Figure 17:
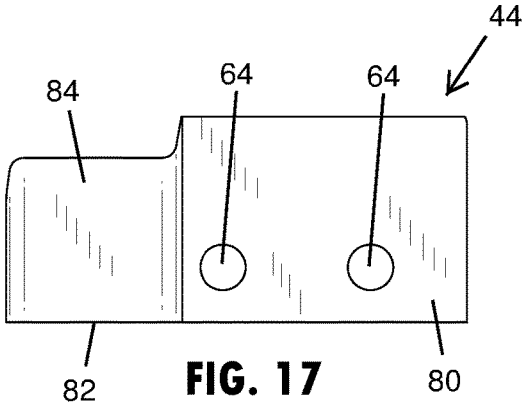
FIG. 17 is a rear elevation view of the door cap shown in FIG. 14.
Figure 18:
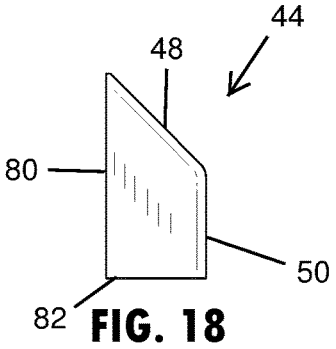
FIG. 18 is a left side elevation view of the door cap shown in FIG. 14.
Figure 19:
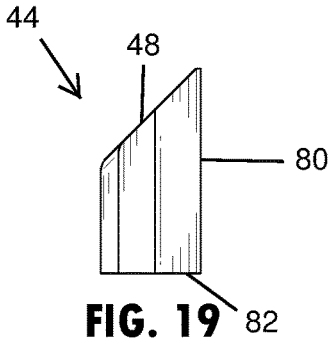
FIG. 19 is a right side elevation view of the door cap shown in FIG. 14.

The frame cap 42 may have various shapes to provide the desired sloped coverage of the frame leaf of the hinge and may also be shaped to overlay the cover 24 of the geared continuous hinge 10 with the door in the closed position 30. As shown in FIGS. 6-13, the frame cap 42 has a solid body construction that provides a rear mounting surface 74 and a bottom overhang surface 76 that is generally perpendicular to the rear mounting surface. The upper sloped surface 46 extends at an approximately 45 degree angle between the upper edge of the rear mounting surface 74 and the forward edge of the bottom surface 76 to form a wedge shape. The recessed portion 70 of the frame cap 42 has a generally vertical front surface 78 that is in alignment with the rear mounting surface 74. The front surface 78 of the recessed portion 70 of the frame cap 42 generally follows the curvature of the interface line 52 when viewed from above, such as shown in FIG. 12. The countersunk holes 64 formed or drilled or bored into the frame cap 42 are generally horizontally oriented in a general orthogonal relation to the rear mounting surface 74, with one formed through the recessed portion 70 and the other formed through the sloped upper surface 46. The exposed edges of the frame cap 42 are smooth and rounded, such as with a filet edge that generally prevents one from using the frame cap 42 for destructive or abusive purposes.

Figure 20:
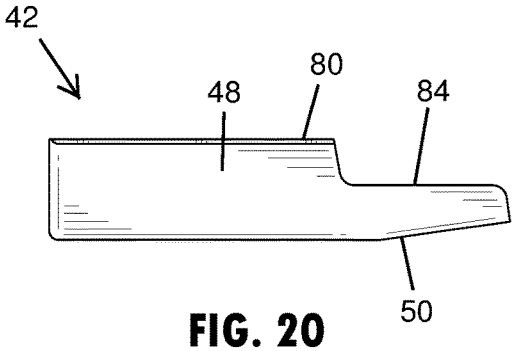
FIG. 20 is a top view of the door cap shown in FIG. 14.
Figure 21:
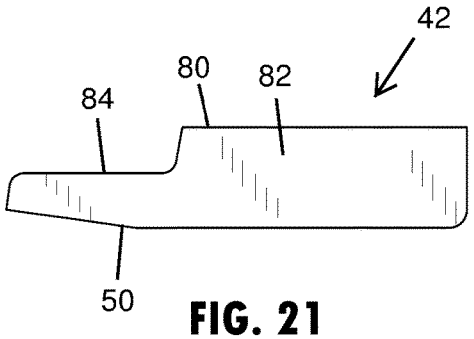
FIG. 21 is a bottom view of the door cap shown in FIG. 14.

The door cap 44, similar to the frame cap 42, may also have various shapes to provide the desired sloped coverage of the door leaf 22 of the hinge and may also be shaped to at least partially overlay the cover of a geared continuous hinge with the door closed. As shown in FIGS. 14-21, the door cap 44 has a solid body construction that provides a rear mounting surface 80 and a bottom overhang surface 82 that is generally perpendicular to the rear mounting surface. The upper sloped surface 48 extends at an approximately 45 degree angle downward from the upper edge of the rear mounting surface to partially form a wedge shape. The upper sloped surface 48 connects at an upper edge of the vertical front surface 50 of the door cap 44 that is vertically oriented and connects with the forward edge of the bottom surface 82. The arm portion 68 of the door cap 44 also has a portion of the vertical front surface 50, although angled slightly rearward to follow the shape of the door leaf of the hinge. The rear surface 84 of the recessed portion of the door cap 44 generally follows the curvature of the interface line 52 when viewed from above, such as shown in FIG. 20 and is a generally planar and uninterrupted surface. The countersunk holes 64 formed or drilled or bored into the door cap 44 are generally horizontally oriented in a general orthogonal relation to the rear mounting surface 80, with both holes 64 formed through the body portion of the door cap 44 and through the vertical front surface 50. The exposed edges of the door cap 44 are smooth and rounded, such as with a filet edge that generally prevents one from using the door cap 44 for destructive or abusive purposes.

Figure 22:
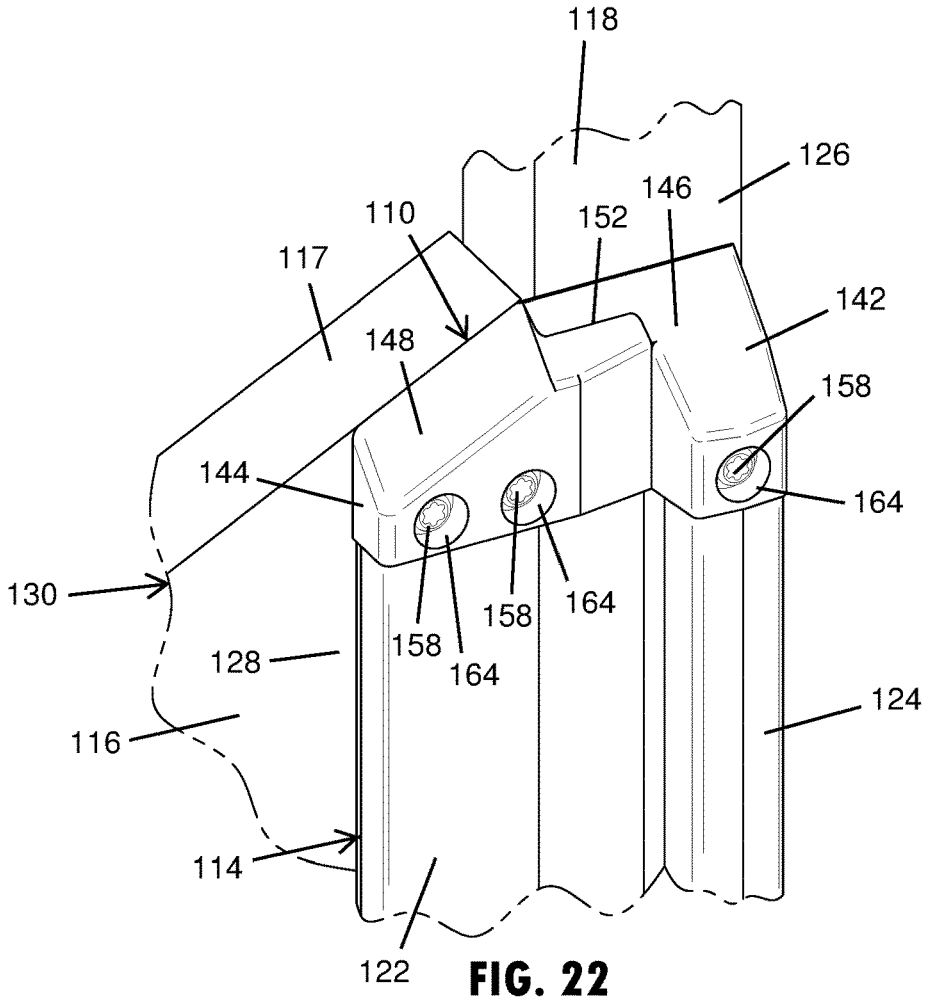
FIG. 22 is an upper perspective view of an additional multi-piece cap mounted above a geared continuous hinge that is installed at a door frame and corresponding door.

Referring now to another example of a multi-piece hinge cap 110 shown in FIG. 22, the door frame 118 is provided without a header immediately above the door 116, such that a unitary hinge cap could not function for such a geared continuous hinge 114. The door frame 118 in this example may be of the type used in a bathroom stall or privacy enclosure of a correctional institution. In the example shown in FIG. 22, a frame leaf is attached to a hinge jamb or vertical member 126 of the door frame 118. The door leaf 122 of the geared continuous hinge 114 is attached along the vertical edge portion 128 of the door 116, which has a slanted top surface 117. In the closed position 130, such as shown in FIG. 22, the door 116 is seated or positioned in the opening of the door frame 118. The multi-piece hinge cap 110 includes a frame cap 142 that attaches to the hinge jamb or vertical member 126 of the door frame 118 immediately above the frame leaf and cover 124 of the geared continuous hinge 114. Also, the multi-piece hinge cap 110 includes a door cap 144 that attaches to the supported door 116 immediately above the door leaf 122 and adjacent to the frame cap 142. The frame and door caps 142, 144 each have a sloped upper surface 146, 148 that slopes downward from the door frame 118 and the door 116, respectively, at an angle of approximately 40 to 50 degrees relative to the vertical planes of the door 116 and the door frame 118 to prevent objects from being supported on the upper surface 112 of the hinge 114. The upper surface 148 of the door cap 144 is also angled laterally downward along the slanted top surface 117 of the door 116 to avoid any sharp edges of the cap from protruding upward beyond the top surface 117 of the door 116. Features of the multi-piece hinge cap 110 and associated geared continuous hinge 114 and doorway arrangement that are similar to the multi-piece hinge cap 10 and associated geared continuous hinge 14 are not described in detail again, and similar reference numbers are used, incremented by 100.

Figure 23:
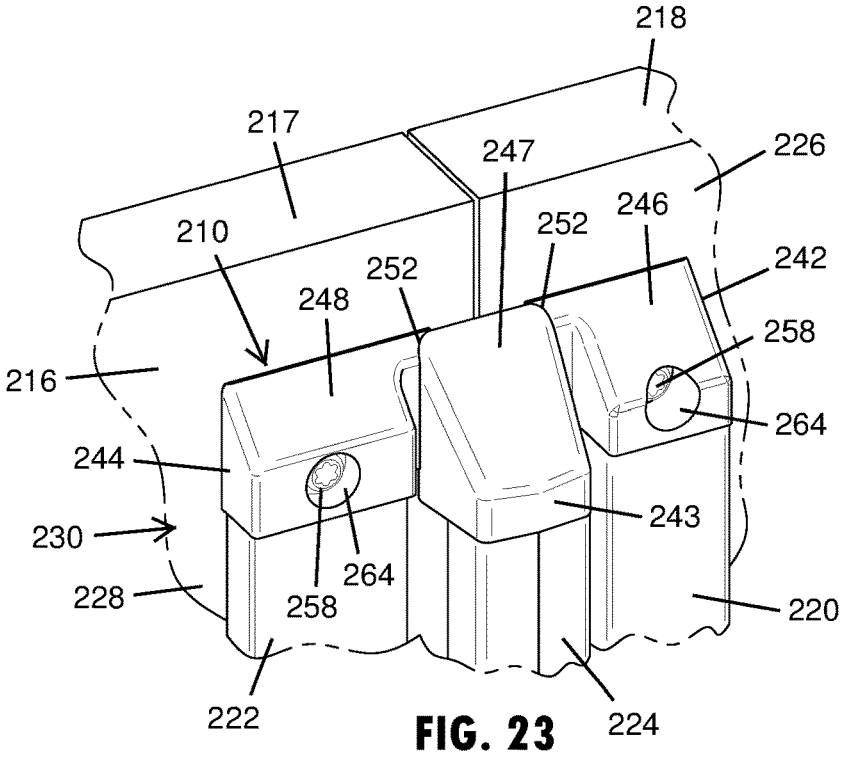
FIG. 23 is an upper perspective view of an additional multi-piece cap mounted above a geared continuous hinge that is installed at a door frame and corresponding door.

Referring to another example of a multi-piece hinge cap 210 shown in FIG. 23, the door frame 218 is provided without a header immediately above the door 216 and without the vertical member 226 of the door frame 218 terminating at a height that is generally equal to the door 216. In such an arrangement, a unitary hinge cap could not function to cover the otherwise exposed upper surface of a geared continuous hinge 214. In the example shown in FIG. 23, the geared continuous hinge 214 is another design of a full surface type hinge with a frame leaf 220 attached to a hinge jamb or vertical member 226 of the door frame 218 and a door leaf 222 attached along the vertical edge portion 228 of the door 216. As shown in FIG. 23, the multi-piece hinge cap 210 includes a frame cap 242 attached to the hinge jamb or vertical member 226 of the door frame 218 immediately above the frame leaf 220 of the geared continuous hinge 214. Also, the multi-piece hinge cap 210 includes a door cap 244 that attaches to the supported door 216 immediately above the door leaf 222 and adjacent to the frame cap 242. The frame and door caps 242, 244 each have a sloped upper surface 246, 248 that slopes downward from the door frame 218 and the door 216, respectively, at an angle of approximately 40 to 50 degrees relative to the vertical planes of the door 216 and the door frame 218 to prevent objects from being supported on the upper surface 212 of the hinge 214.

As further shown in FIG. 23, the cover 224 of the geared continuous hinge 214 that holds meshed gear sections of the frame leaf 220 and door leaf 222 together along a length of the geared continuous hinge 214 is generally centered between the frame leaf 220 and door leaf 222. As such, the multi-piece hinge cap 210 includes a cover cap 243 that attaches to the cover 224 to cover the upper surface thereof. Specifically, the cover cap 243 is an independent piece from the leaf cap 246 and the door cap 248, such that the cover cap 243 may have a downward extending member that engages the inside area of the cover 224, which may be made available to receive the cover cap 243 by removing the meshed geared sections of the frame leaf 220 and door leaf 222 at the upper interior area of the cover 224. Thus, the downward extending member of the cover cap 243 may be attached within the inside area of the cover 224, such as with a fastener, adhesive, and/or welding.

The cover cap 243, such as shown in FIG. 23, has a sloped upper surface 247 that slopes downward from the door frame 218 and the door 216, respectively, at an angle that generally aligns with the frame and door caps 242, 244 when the door is in the closed position. Features of the multi-piece hinge cap 210 and associated geared continuous hinge 214 and doorway arrangement that are similar to the multi-piece hinge cap 10 and associated geared continuous hinge 14 are not described in detail again, and similar reference numbers are used, incremented by 200.

It is to be understood that the specific devices and processes illustrated in the attached drawings, and described in this specification are simply exemplary embodiments of the inventive concepts defined in the appended claims. Hence, specific values and other precise physical characteristics relating to the embodiments disclosed herein are not to be considered as limiting, unless the claims expressly state otherwise.

Changes and modifications in the specifically described embodiments may be carried out without departing from the principles of the present disclosure, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A multi-piece hinge cap for covering an upper surface of an installed geared continuous hinge to provide ligature resistance with a door supported by the installed geared continuous hinge in a closed position, said multi-piece hinge cap comprising:

a frame cap configured to be attached at a vertical member of a door frame above a frame leaf of the installed geared continuous hinge;

a door cap configured to be positioned adjacent to the frame cap and attached at the door above a door leaf of the installed geared continuous hinge, wherein the door cap includes an arm portion that, with the door in the closed position, protrudes toward the frame cap and overlaps with a recessed portion of the frame cap; and wherein the frame and door caps each comprise an upper surface having a downward sloping angle that is configured to slope downward from the door frame and the door, respectively, and extend over the exposed upper surface of the installed geared continuous hinge.

2. The multi-piece hinge cap of claim 1, further comprising a fastener that has a head portion and a shank portion that is configured to extend through a hole in one of the frame cap or the door cap to mount the respective frame cap or door cap at the door frame or door.

3. The multi-piece hinge cap of claim 2, wherein, with the shank portion engaged at the door frame or door, the head portion of the fastener is at least partially disposed in an enlarged section of the hole.

4. The multi-piece hinge cap of claim 1, wherein, with the door in the closed position, the door cap contacts the frame cap and the upper surfaces of the door cap and the frame cap are aligned to provide a continuous sloped surface that is configured to overhang the exposed upper surface of the installed geared continuous hinge.

5. The multi-piece hinge cap of claim 1, wherein, with the door in the closed position, the door cap contacts the frame cap along an interface line between the upper surfaces of the door cap and the frame cap, and wherein the interface line has a curved shape that is configured to permit movement of the door toward an open position.

6. The multi-piece hinge cap of claim 1, wherein, with the door in the closed position, the arm portion of the door cap contacts the recessed portion of the frame cap along an interface line that has an S-shape between the upper surfaces of the door cap and the frame cap.

7. The multi-piece hinge cap of claim 1, further comprising a fastener that extends through the recessed portion of the frame cap, wherein the arm portion of the door cap conceals a head portion of the fastener when the door is in the closed position.

8. The multi-piece hinge cap of claim 1, wherein the door cap and the frame cap each comprise a rigid material, and wherein the upper surfaces of the door cap and the frame cap each comprise a low friction finish.

9. A ligature resistant hinge assembly, comprising:

a geared continuous hinge having a frame leaf in meshed engagement with a door leaf and a cover holding meshed gear sections of the frame leaf and the door leaf together along a length of the geared continuous hinge, wherein the frame leaf is configured to be mounted at a door frame and the door leaf is configured to be mounted to a door that is movable between open and closed positions about the geared continuous hinge;

a frame cap having a wedge shape and being configured to attach to the door frame above the frame leaf of the geared continuous hinge;

a door cap having a wedge shape and being configured to attach to the door above the door leaf and adjacent to the frame cap;

wherein the frame and door caps each comprise an upper surface having a downward sloping angle that is configured to slope downward from the door frame and the door, respectively, and extend over an exposed upper surface of the geared continuous hinge; and wherein, with the door in the closed position, the door cap contacts the frame cap along an interface line between the upper surfaces of the door cap and the frame cap, and wherein the interface line has a curved shape that is configured to permit movement of the door toward the open position.

10. The ligature resistant hinge assembly of claim 9, further comprising a fastener that has a head portion and a shank portion that is configured to extend through a countersunk hole in each of the frame cap or the door cap to mount the respective frame cap and door cap at the door frame and the door.

11. The ligature resistant hinge assembly of claim 10, wherein, with the shank portion engaged at the door frame or the door, the head portion of the fastener is at least partially disposed in a head section of the countersunk hole.

12. The ligature resistant hinge assembly of claim 9, wherein, with the door in the closed position, the upper surfaces of the door cap and the frame cap align to provide a continuous sloped surface that is configured to overhang the exposed upper surface of the installed geared continuous hinge.

13. The ligature resistant hinge assembly of claim 9, wherein the door cap includes an arm portion that protrudes toward the frame cap and overlaps with a recessed portion of the frame cap with the door in the closed position.

14. The ligature resistant hinge assembly of claim 13, further comprising a fastener that extends through the recessed portion of the frame cap, wherein the arm portion of the door cap conceals a head portion of the fastener when the door is in the closed position.

15. The ligature resistant hinge assembly of claim 9, wherein the frame cap is mounted at a vertical member of the door frame below a header of the door frame.

16. A multi-piece hinge cap for covering an upper surface of an installed geared continuous hinge to provide ligature resistance with a door supported by the installed geared continuous hinge in a closed position, said multi-piece hinge cap comprising:

a frame cap configured to be fastened at a door frame above a frame leaf of the installed geared continuous hinge;

a door cap configured to be positioned adjacent to the frame cap and attached at the door above a door leaf of the installed geared continuous hinge;

wherein the frame and door caps each include a rear surface for mounting at the respective door frame and door and each include an angled front surface that extends forward and slopes downward from the rear surface to extend over the exposed upper surface of the respective frame leaf and door leaf; and wherein, with the door in the closed position, the door cap contacts the frame cap along an interface line between the upper surfaces of the door cap and the frame cap, and wherein the interface line has a curved shape that is configured to permit movement of the door toward an open position.

17. The multi-piece hinge cap of claim 16, further comprising a fastener that has a head portion and a shank portion that is configured to extend through a countersunk hole in one of the frame cap or the door cap to mount the respective frame cap or door cap at the door frame or door, wherein, with the shank portion engaged at the door frame or door, the head portion of the fastener is at least partially concealed in an enlarged section of the countersunk hole.

18. The multi-piece hinge cap of claim 16, wherein the door cap includes an arm portion that protrudes toward the frame cap and overlaps with a recessed portion of the frame cap with the door in the closed position, and wherein, with the door in the closed position, the arm portion of the door cap contacts the recessed portion of the frame cap along the interface line that has an S-shape between the upper surfaces of the door cap and the frame cap.

* * * * *